US010465466B2

(12) United States Patent
Angstmann et al.

(10) Patent No.: US 10,465,466 B2
(45) Date of Patent: Nov. 5, 2019

(54) BLOWOUT PREVENTER

(71) Applicant: Kinetic Pressure Control, Ltd., Houston, TX (US)

(72) Inventors: Steven Anthony Angstmann, Houston, TX (US); Bobby James Gallagher, Houston, TX (US)

(73) Assignee: Kinetic Pressure Control, Ltd., Houston, TX (US)

( * ) Notice: Subject to any disclaimer, the term of this patent is extended or adjusted under 35 U.S.C. 154(b) by 63 days.

(21) Appl. No.: 15/789,596

(22) Filed: Oct. 20, 2017

(65) Prior Publication Data

US 2018/0080300 A1 Mar. 22, 2018

Related U.S. Application Data

(63) Continuation of application No. PCT/AU2016/050310, filed on Apr. 29, 2016.

(60) Provisional application No. 62/155,992, filed on May 1, 2015.

(51) Int. Cl.
*E21B 33/06* (2006.01)

(52) U.S. Cl.
CPC ..... *E21B 33/063* (2013.01)

(58) Field of Classification Search
CPC ..... E21B 33/063
USPC ..... 251/1.3, 1.2; 166/361, 636
See application file for complete search history.

(56) References Cited

U.S. PATENT DOCUMENTS

| | | | | |
|---|---|---|---|---|
| 3,716,068 | A * | 2/1973 | Addison | E21B 29/08 137/318 |
| 3,766,979 | A * | 10/1973 | Petrick | E21B 29/08 166/55 |
| 3,771,601 | A * | 11/1973 | Garrett | E21B 29/02 166/297 |
| 7,694,730 | B2 | 4/2010 | Angman | |
| 7,721,820 | B2 | 5/2010 | Hill et al. | |
| 8,316,872 | B1 * | 11/2012 | Milanovich | E21B 33/061 137/68.13 |
| 8,567,427 | B1 * | 10/2013 | Milanovich | E21B 33/061 137/68.13 |
| 8,794,308 | B1 | 8/2014 | Milanovich | |
| 9,863,202 | B2 * | 1/2018 | Rytlewski | E21B 23/04 |
| 2016/0319623 | A1 * | 11/2016 | Larson | E21B 33/061 |

FOREIGN PATENT DOCUMENTS

WO 2016/176100 A1 11/2016

OTHER PUBLICATIONS

Written Opinion of the International Search Authority, International Application No. PCT/AU2016/050310, dated Jun. 23, 2016.
International Search Report, International Application No. PCT/AU2016/050310, dated Jun. 23, 2016.

(Continued)

*Primary Examiner* — Umashankar Venkatesan
(74) *Attorney, Agent, or Firm* — Richard A. Fagin

(57) ABSTRACT

A blowout preventer and method of closing a wellbore. The blowout prevented has a main body containing a wellbore, a passage transverse to the wellbore, a shearing device located in the passage; and a charge that, when activated, propels the shearing device along the passage and across the wellbore to close the wellbore and prevent a blowout.

24 Claims, 10 Drawing Sheets

(56) References Cited

OTHER PUBLICATIONS

Extended European search report, Application No. 16788951.8-1002 / 3289169.
Examination Report, Australian Patent Application No. 2016257771.

* cited by examiner

BLOWOUT PREVENTER

CROSS REFERENCE TO RELATED APPLICATIONS

Continuation of International Application No. PCT/AU2016/050310 filed on Apr. 29, 2016. Priority is claimed from U.S. Provisional Application No. 62/155,992 filed on May 1, 2015.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

The present disclosure relates to a blowout preventer. In particular, although not exclusively, the present disclosure relates to a blowout preventer for an oil or gas well.

Blowout preventers (BOPs) for oil or gas wells are used to prevent potentially catastrophic events known as a blowouts, where high pressures and uncontrolled flow from a well reservoir can blow tubing (e.g. drill pipe and well casing), tools and drilling fluid out of a wellbore. Blowouts present a serious safety hazard to drilling crew, the drilling rig and the environment and can be extremely costly.

Typically BOPs have rams that are hydraulically pushed across the wellbore to close off the wellbore. In some cases the rams have hardened steel shears to cut through a drill string which may be in the wellbore.

A problem with many of the hydraulically actuated rams is that they require a large amount of hydraulic force to move the rams against the pressure inside the wellbore and to cut through drill strings.

An additional problem with hydraulically actuated rams is that the hydraulic force is typically generated away from the blowout preventer, making the blowout preventer susceptible to failure if the hydraulic line conveying the hydraulic force is damaged. Further problems may include the erosion of cutting and sealing surfaces due to the relatively slow closing action of the rams in a flowing wellbore. Cutting through tool joints, drill collars, large diameter tubulars and off centre drill strings under heavy compression may also present problems for hydraulically actuated rams.

Typically, once the rams have closed off the wellbore and the well has been brought under control, the rams are either retracted or drilled through so that drilling may be resumed.

It will be clearly understood that any reference herein to background material or information, or to a prior publication, does not constitute an admission that any material, information or publication forms part of the common general knowledge in the art, or is otherwise admissible prior art.

SUMMARY

In one form, although it need not be the only or indeed the broadest form, the present disclosure relates to a blowout preventer comprising:

a main body containing a wellbore;

a passage transverse to the wellbore;

a shearing device located in the passage; and a charge, that when activated propels the shearing device along the passage and across the wellbore.

In some embodiments, the shearing device has a body section that can effectively block the wellbore and prevent the mass passage of wellbore fluids through the wellbore. In some embodiments, the shearing device has a sealing face of sufficient length and thickness to engage with a wellbore sealing arrangement to prevent passage of wellbore fluids. In some embodiments, the shearing device has a cutting edge that can cut through tubular sections in the wellbore. The cutting edge is typically of very hard material such as metallic or ceramic alloys.

In some embodiments, the blow out preventer comprises a retaining device. Typically the retaining device retains the shearing device in a predefined position in the passage until a sufficient force is exerted on the shearing device. In some embodiments, the retaining device comprises a shear pin arrangement.

In some embodiments, the shearing device has two slots in the outer edges of the body section, which are adapted to engage with an arresting mechanism.

In some embodiments, the shearing device has at least one pressure equalizing channel in a upper surface of the body section.

In some embodiments, the charge comprises a chemical propellant. For example, the chemical propellant may be a deflagrating charge. In some embodiments, the charge may be an explosive charge. In some embodiments, the charge is activated by an initiator. For example, the initiator may be a detonator. The charge is typically contained within a cartridge casing. In some embodiments, the charge may be contained within a portion of the shearing device.

In some embodiments, the passage transversely intersects the wellbore. In some embodiments, the passage has two portions, a first portion on a first side of the wellbore and a second portion on a second side of the wellbore. In some embodiments, the shearing device is initially located in the first portion of the passage on the first side of the wellbore. In some embodiments, the passage comprises a space in the first portion of the passage between the initial location of the shearing device and the wellbore. In some embodiments, the space between the initial location of the shearing device and the wellbore is at least as long as half the diameter of the wellbore. More preferably the space between the initial location of the shearing device and the wellbore is longer than the diameter of the wellbore. In some embodiments, the space between the initial location of the shearing device and the wellbore is devoid of liquid. More preferably the space between the initial location of the shearing device and the wellbore is filled with a gas. In some embodiments, the passage has a liner which fits within the passage and provides a close tolerance fit between itself and the shearing device.

Typically the passage is fluidly sealed from the wellbore. In some embodiments, a seal fluidly seals the passage from the wellbore. In some embodiments, the seal is in the form of a cylinder that extends in the direction of the wellbore. The seal is typically of a material that is strong enough to withstand the pressure differences between the wellbore and the passage. The seal typically prevents wellbore fluids from entering the passage prior to being sheared by the shearing device.

In some embodiments, the blowout preventer comprises an arresting mechanism. In some embodiments, the arresting mechanism is located in the passage. In some embodiments, the arresting mechanism is located in the second portion of the passage on the second side of the wellbore. In some embodiments, the arresting mechanism is in the form of an energy absorption mechanism. The energy absorption mechanism is typically adapted to absorb the energy of the shearing device once it has been propelled across the wellbore.

In some embodiments, the energy absorption mechanism has a front portion (i.e. facing towards the shearing device), a rear portion and a body of energy absorbing material located between the front portion and the rear portion.

In some embodiments, the portion of the passage that the energy absorption mechanism is located in has a larger cross sectional area than the portion of the passage that the shearing device is initially located in.

In some embodiments, the front portion of the energy absorption device is adapted to attach to the shearing device.

In some embodiments, behind the rear portion of the energy absorption mechanism (i.e. other side of the energy absorption mechanism to the shearing device), the passage is filled with a hydraulic fluid. In some embodiments, the rear portion of the energy absorption mechanism is a sliding piston, which can slide within the passage.

In some embodiments, the blowout preventer further comprises a wellbore sealing arrangement adapted to seal between the wellbore and the shearing device once the shearing device is located across the wellbore. In some embodiments, the wellbore sealing arrangement has a sealing ring that is adapted to be pressed onto the sealing face of the shearing device. In some embodiments, the sealing ring is located concentrically with the wellbore, having a larger diameter than the wellbore.

In some embodiments, the blowout preventer is connected to an existing wellhead. More preferably, the blow out preventer is connected in line between the existing wellhead and one or more standard blowout preventers.

In some embodiments, the blowout preventer is capable of operating in up to 18,000 feet Salt Water. In some embodiments, the blowout preventer is capable of withstanding well bore pressures of up to 20,000 PSI. More preferably the blowout preventer is capable of withstanding well bore pressures of up to 30,000 PSI. However, it will be appreciated that the blowout preventer may be equally capable of operating at sea level or at elevations above sea level. For example, the blowout preventer may be used as a surface blowout preventer or on a land rig.

In another form the present disclosure resides in a drilling rig comprising a blowout preventer as described in this specification.

In a further form the present disclosure resides in a deep water drilling vessel comprising a drilling rig and a blowout preventer as described in this specification In another aspect, the present disclosure relates to a method of closing a wellbore located within a main body of a blowout preventer, the method comprising:

activating a charge to propel a shearing device along a passage transverse to the wellbore, such that the shearing device travels across the wellbore to inhibit the flow of wellbore fluids through the wellbore.

In some embodiments, the method includes the step of the shearing device being propelled through a seal fluidly sealing the passage from the wellbore.

In some embodiments, the method includes the step of the shearing device travelling into an energy absorption mechanism located in the passage.

Typically when the charge is activated, this results in a rapid expansion of gases which accelerates the shearing device along the passage, imparting kinetic energy on the shearing device. In some embodiments, the shearing device is accelerated along the passage in the space between the initial location of the shearing device and the wellbore. Typically, the amount of kinetic energy imparted on the shearing device is sufficient to shear any elements which may be present in the wellbore with or without the assistance of pressure from the charge acting on the shearing device.

In some embodiments, activating the charge includes activating the charge by an initiator in response to a control signal. For example, the chemical propellant may be activated by the initiator in response to a hydraulic signal or an electrical signal. The chemical propellant may also be activated in a fail safe manner. For example, the chemical propellant may be activated by the initiator in response to a loss of a control signal.

In some embodiments, the method includes retaining the shearing device until a sufficient expansion of the charge has occurred. For example, a retaining device in the form of a shear pin arrangement retains the shearing device until a sufficient expansion of the charge (e.g. hot gases) has occurred after activation of the charge, this assists in the rapid acceleration of the shearing device before it travels across the wellbore, or touches the seal.

In some embodiments, the method includes the step of guiding the shearing device during its rapid acceleration with a liner located in the passage.

In some embodiments, the method further includes the step of venting the activated charge downwards into the wellbore. For example, once a body section of the shearing device has travelled sufficiently far across the wellbore, remaining hot expanding gases (from the activated charge) can vent downwards into the wellbore, through at least one equalizing channel in a upper surface of the body section, thus removing the propelling force for continued forward motion of the shearing device along the passage.

In some embodiments, the method includes the step of absorbing the kinetic energy of the shearing device. In some embodiments, an energy absorbing material absorbs the kinetic energy of the shearing device. The energy absorbing material is typically adapted to progressively crumple at a predefined rate, as it absorbs energy from the shearing device, eventually bringing the shearing device to rest.

In some embodiments, absorbing the kinetic energy of the shearing device includes hydraulically dissipating the kinetic energy. For example, if there is still residual kinetic energy in the shearing device when it has dissipated some of the kinetic energy by 'crumpling' the energy absorbing material, hydraulic fluid located in the passage behind the energy absorbing device will prevent the shearing device from passing beyond the position where it inhibits the flow of wellbore fluids through the wellbore.

In some embodiments, the method includes the step of sealing between the wellbore and a sealing face of the shearing device to inhibit progression of wellbore fluids through the blowout preventer. Typically, the wellbore sealing arrangement is actuated by an external hydraulic force. In some embodiments, the external hydraulic force firmly presses a sealing ring against the sealing face of the shearing device to form a seal against further progression of wellbore fluids through the blowout preventer. It will be understood that if the shearing device is to be pulled clear of the wellbore, the sealing ring is typically retracted from the sealing face of the shearing device.

In some embodiments, the method includes the step of pulling the shearing device clear of the wellbore. This is typically done once well control has been re-established, so that further well control or recovery operations may continue. Typically, the shearing device is pulled clear of the wellbore by venting at least a portion of the hydraulic fluid from the passage. Typically, when the hydraulic fluid is vented from the passage, the energy absorption mechanism acts as a piston to pull the shearing device clear of the wellbore.

Further aspects of the present disclosure will become apparent from the following detailed description.

BRIEF DESCRIPTION OF THE DRAWINGS

To assist in understanding the present disclosure and to enable a person skilled in the art to put the present disclosure into practical effect, preferred embodiments of the present disclosure will be described by way of example only with reference to the accompanying drawings, wherein.

DETAILED DESCRIPTION

Figure 1:
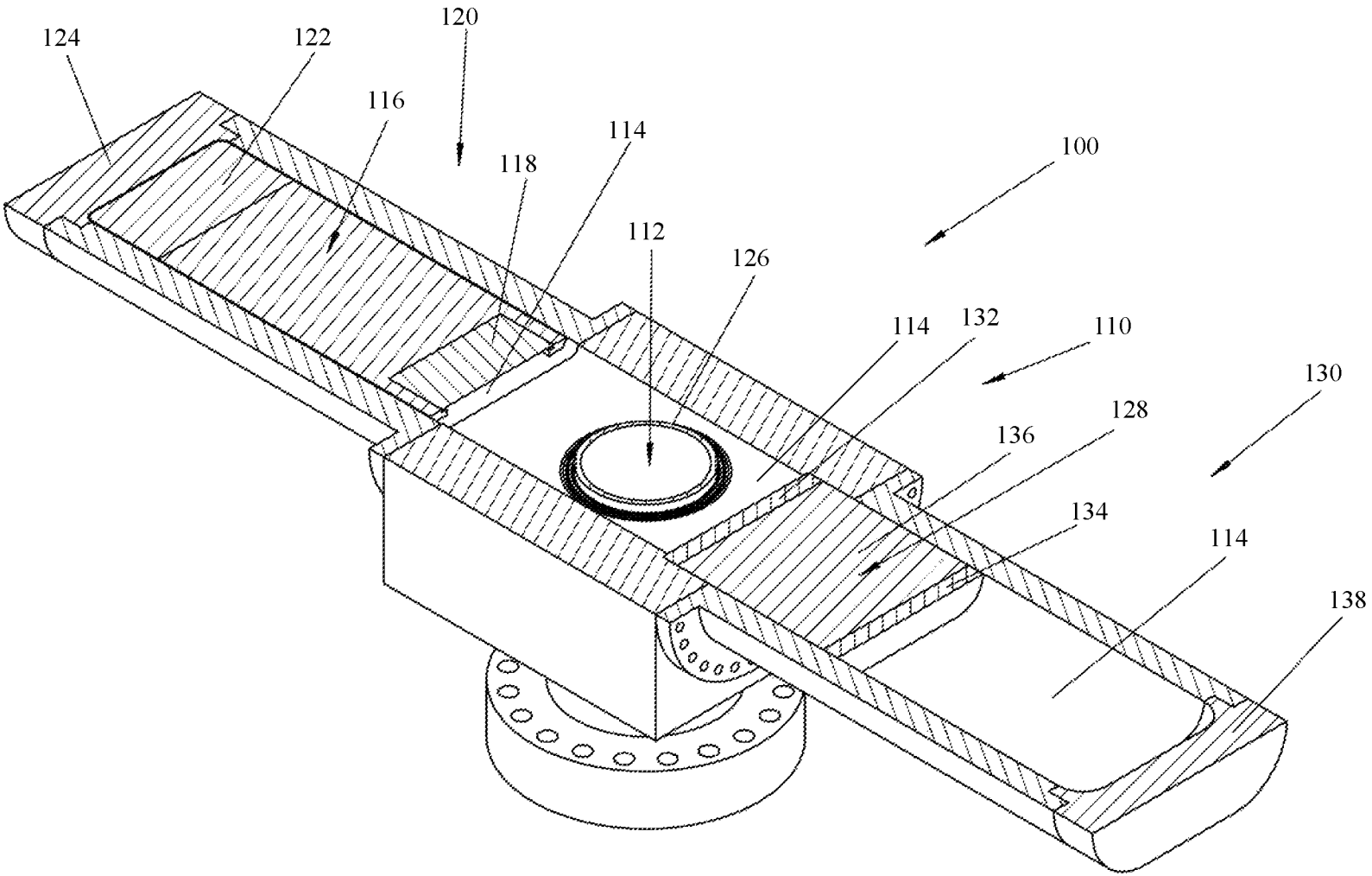
FIG. 1 shows a sectioned view of a blowout preventer according to an embodiment of the present disclosure.

With reference to FIG. 1, there is shown a sectioned view of a blowout preventer 100 according to an embodiment of the present disclosure. The blowout preventer 100 has a main body 110 having a wellbore 112. The blowout preventer 100 also has a passage 114 that is located transverse to the wellbore 112. A shearing device 116 having a cutting edge 118 is located in the passage 114 on a first side 120 of the wellbore 112. A charge in the form of a chemical propellant 122 is located between the shearing device 116 and an end cap 124. The chemical propellant 122 is adapted to propel the shearing device 116 along the passage 114 and across the wellbore 112, as will be described in greater detail below.

A seal in the form of a cylinder 126 fluidly seals the passage 114 from the wellbore 112.

An arresting mechanism in the form of an energy absorption mechanism 128 is located in the passage 114 on a second side 130 of the wellbore 112. The energy absorption mechanism 128 has a front portion 132 facing towards the shearing device 116, a rear portion 134 and a body of energy absorbing material 136 located between the front portion 132 and the rear portion 134. The energy absorption mechanism 128 is adapted to absorb the kinetic energy of the shearing device 116, as will be described in greater detail below. The rear portion 134 of the energy absorption mechanism 128 is a sliding piston, which can slide within the passage 114 on the second side 130 of the wellbore 112. As can be seen in FIG. 1 the passage 114 on the second side 130 of the wellbore 112 has a larger cross section than the passage 114 on the first side 120 of the wellbore 112. The portion of the passage 114 between the rear portion 134 of the energy absorption mechanism 128 and an end cap 138 is filled with hydraulic fluid.

The operation of the blowout preventer 100 will now be explained with reference to FIGS. 2-8.

Figure 2:
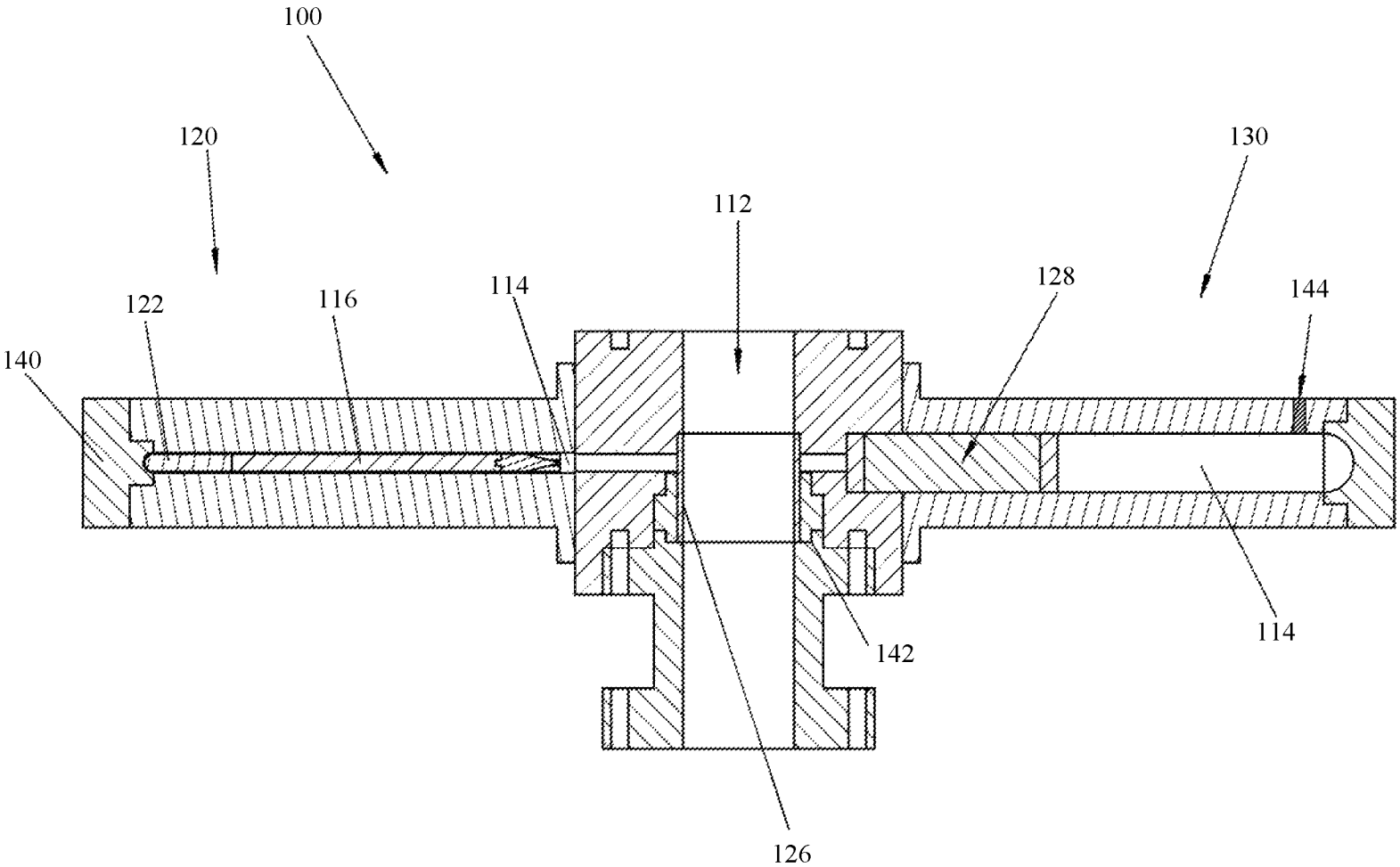
FIG. 2 shows a cross section view of a blowout preventer prior to being activated.

With reference to FIG. 2, there is shown a cross section view of the blowout preventer 100 prior to being activated. As can be seen in FIG. 2, the chemical propellant 122 and shearing device 116 are located in the passage 114 on a first side 120 of the wellbore 112.

FIG. 2 also shows an initiator in the form of a blasting cap 140 which is adapted to activate the chemical propellant 122. FIG. 2 also shows the cylinder 126 fluidly sealing the passage 114 from the wellbore 112.

Around the wellbore 112 is located a wellbore sealing arrangement 142, which will be explained in more detail below.

The energy absorption mechanism 128 is located within the passage 114 on the second side 130 of the wellbore 112.

Figure 3:
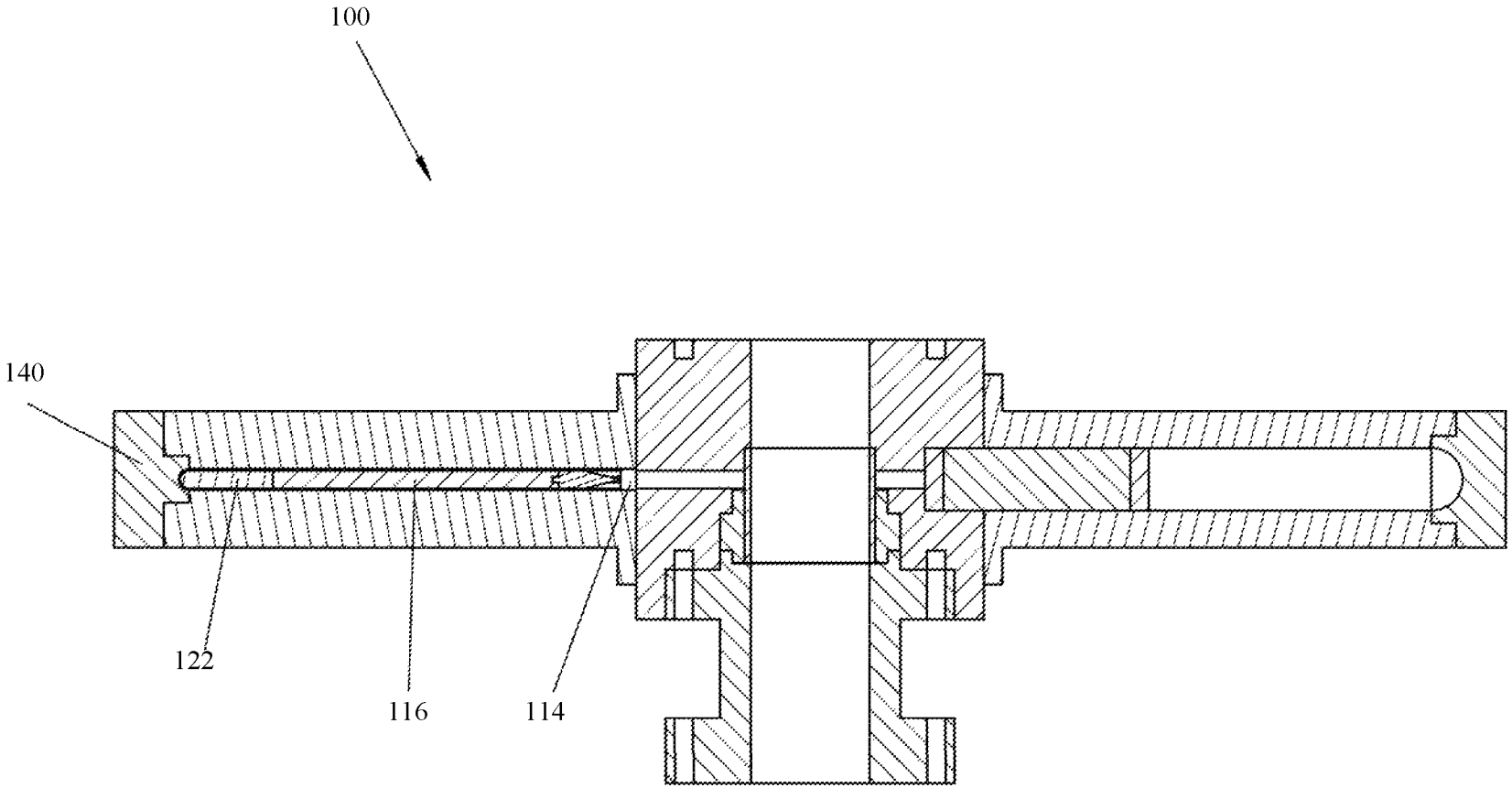
FIG. 3 shows a cross section view of a blowout preventer that has been activated.

FIG. 3 shows a cross section view of the blowout preventer 100 where the chemical propellant 122 has been activated by the blasting cap 140. The shearing device 116 is held in place by a shear pin (not shown) until a sufficient expansion of hot gases has occurred after activation of the chemical propellant 122.

Figure 4:
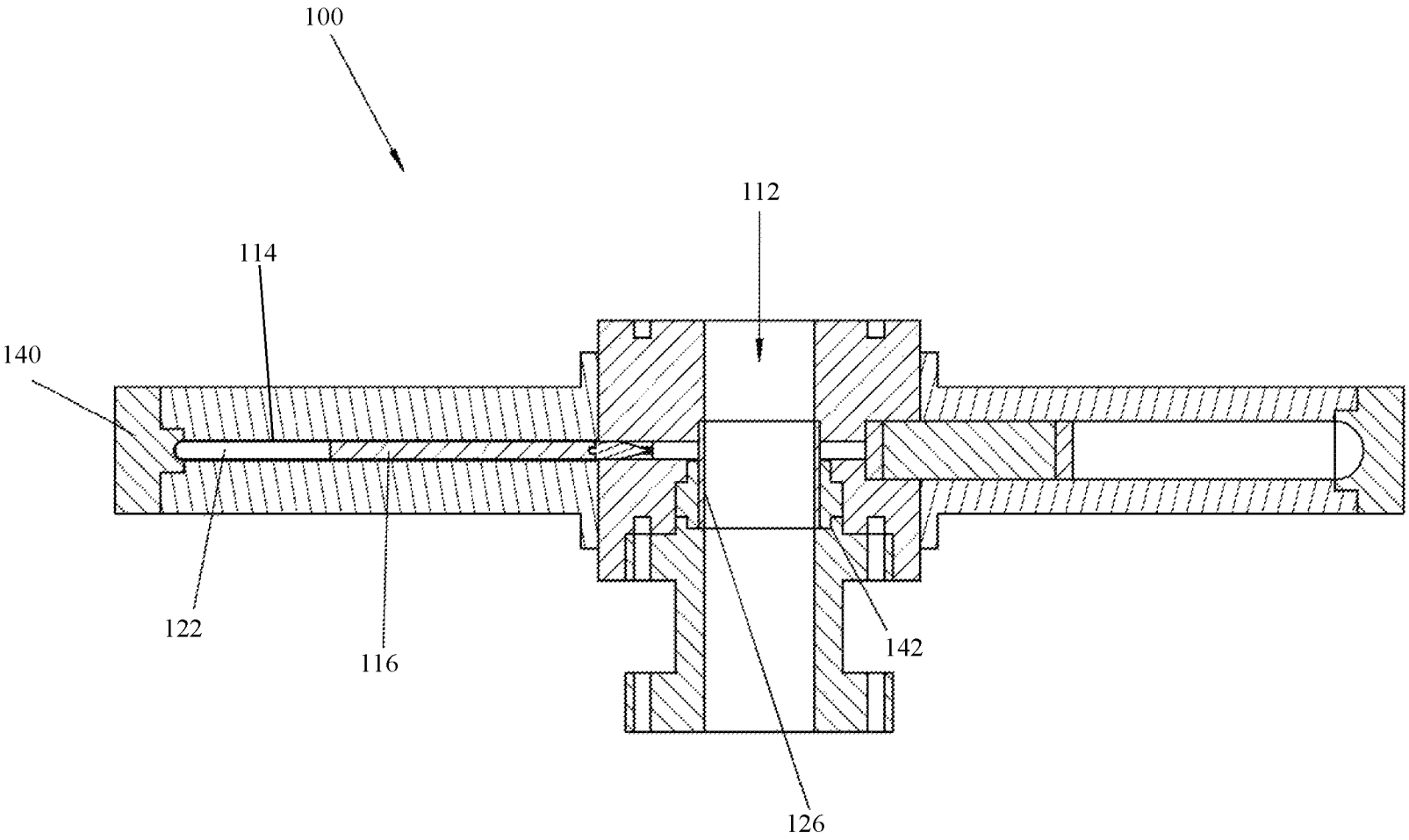
FIG. 4 shows a cross section view of a blowout preventer with the shearing device accelerating along the passage.

FIG. 4 shows a cross section view of the blowout preventer 100 where a sufficient expansion of hot gases has occurred after activation of the chemical propellant 122 to shear the shear pin (not shown). At this stage, the shearing device 116 is accelerating along the passage 114 towards the cylinder 126 and wellbore 112.

Figure 5:
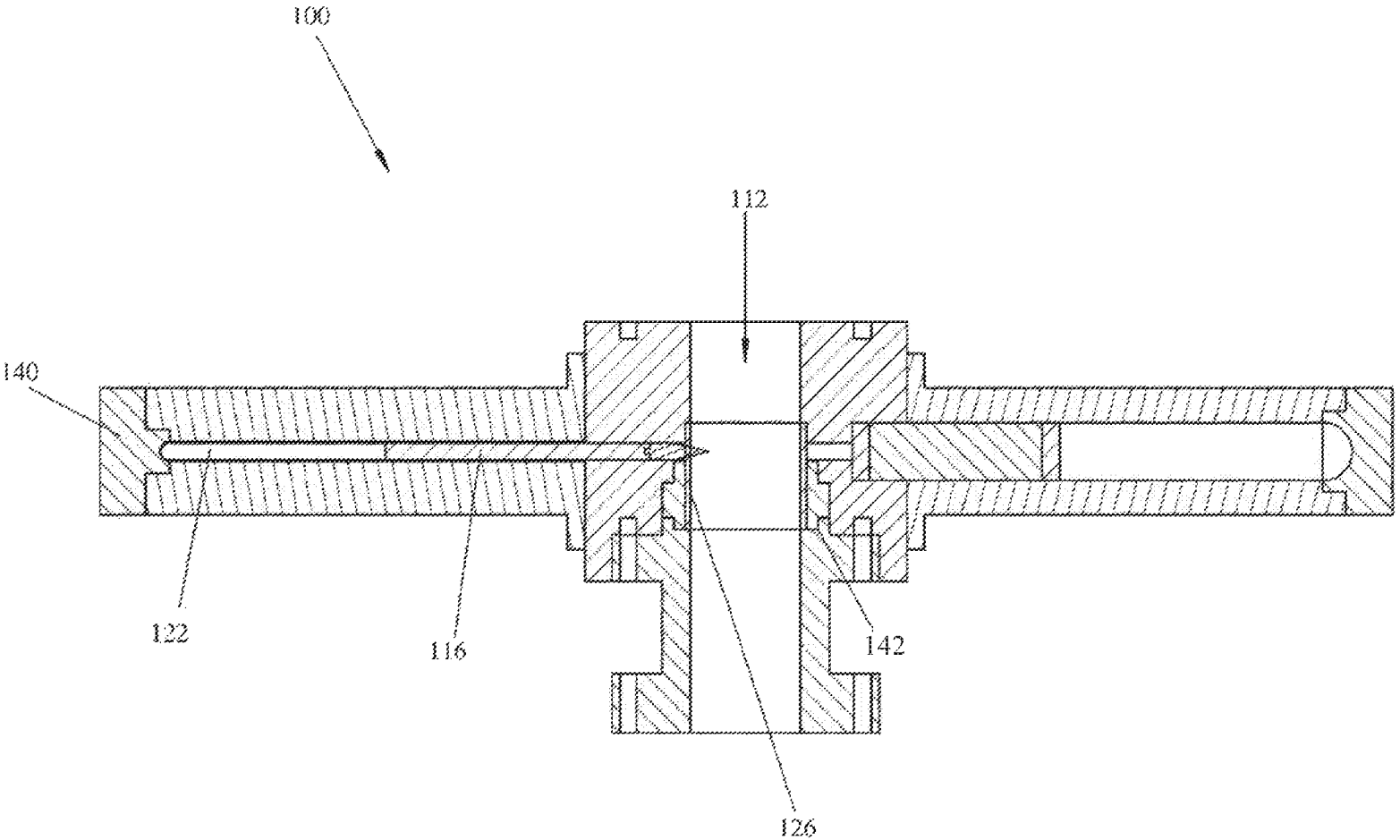
FIG. 5 shows a cross section view of a blowout preventer with the shearing device piercing the seal.

FIG. 5 shows a cross section view of the blowout preventer 100. At this stage, the shearing device 116 has begun to shear the cylinder 126. The shearing device will also shear any wellbore tubulars, tools, drill strings or the like which are present in the wellbore. The passage 114 on the first side 120 of the wellbore 112 contains a passage liner (not shown). The passage liner provides a close tolerance fit between itself and the shearing device 116. The liner controls the by-passing of the hot expanding gases from the exothermic reaction of the chemical propellant 122 and guides the shearing device 116 during its rapid acceleration and shearing phase of operation.

Figure 6:
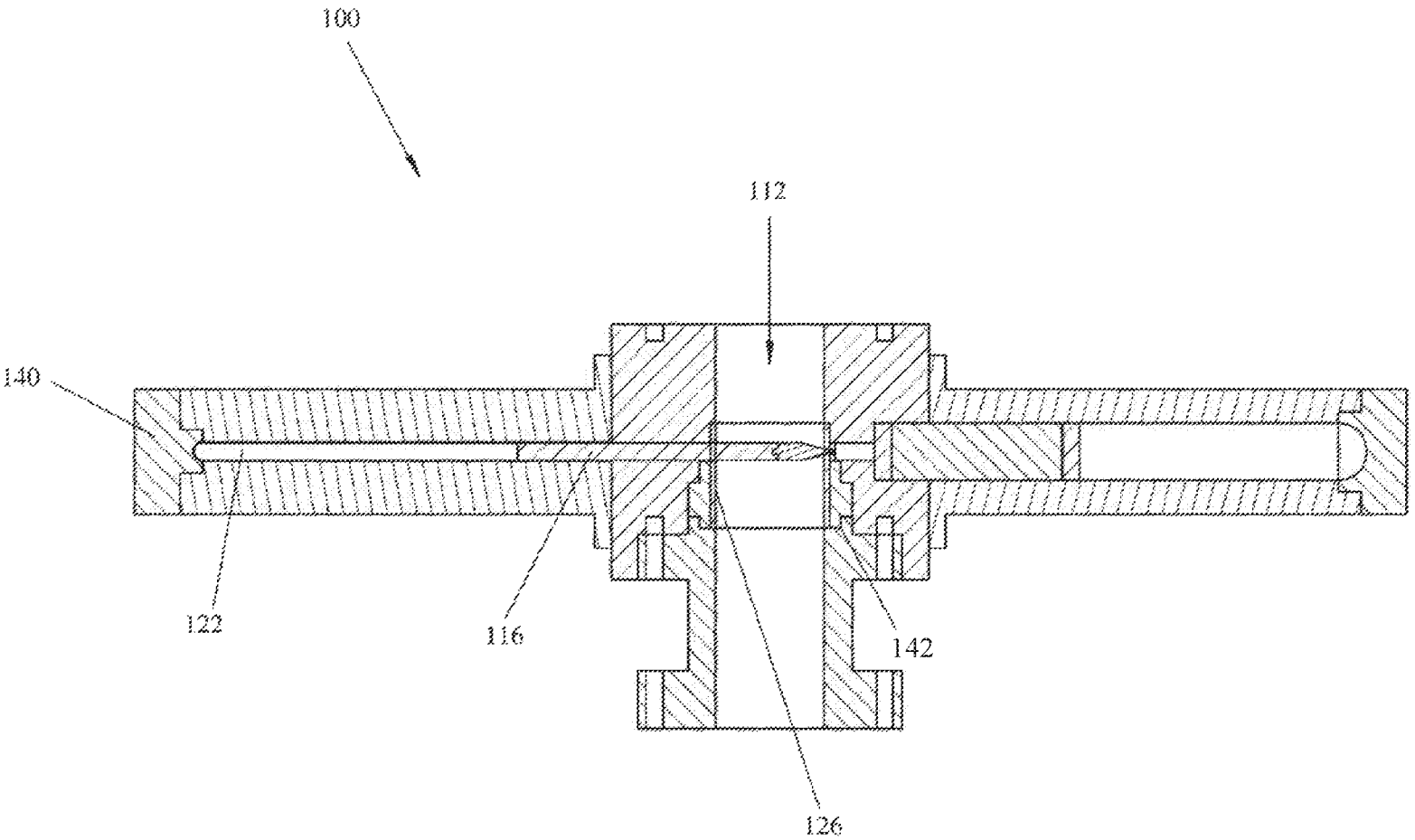
FIG. 6 shows a cross section view of a blowout preventer with the shearing device across the wellbore.

FIG. 6 shows a cross section view of the blowout preventer 100. At this stage, the shearing device 116 has sheared through the cylinder 126 and anything else that may have been located in the wellbore 112. The upper portion of the shearing device 116 has channels (not shown) such that once the shearing device 116 is sufficiently across the wellbore 112, the expanding gases from the chemical propellant 122 are vented down into the wellbore.

Figure 7:
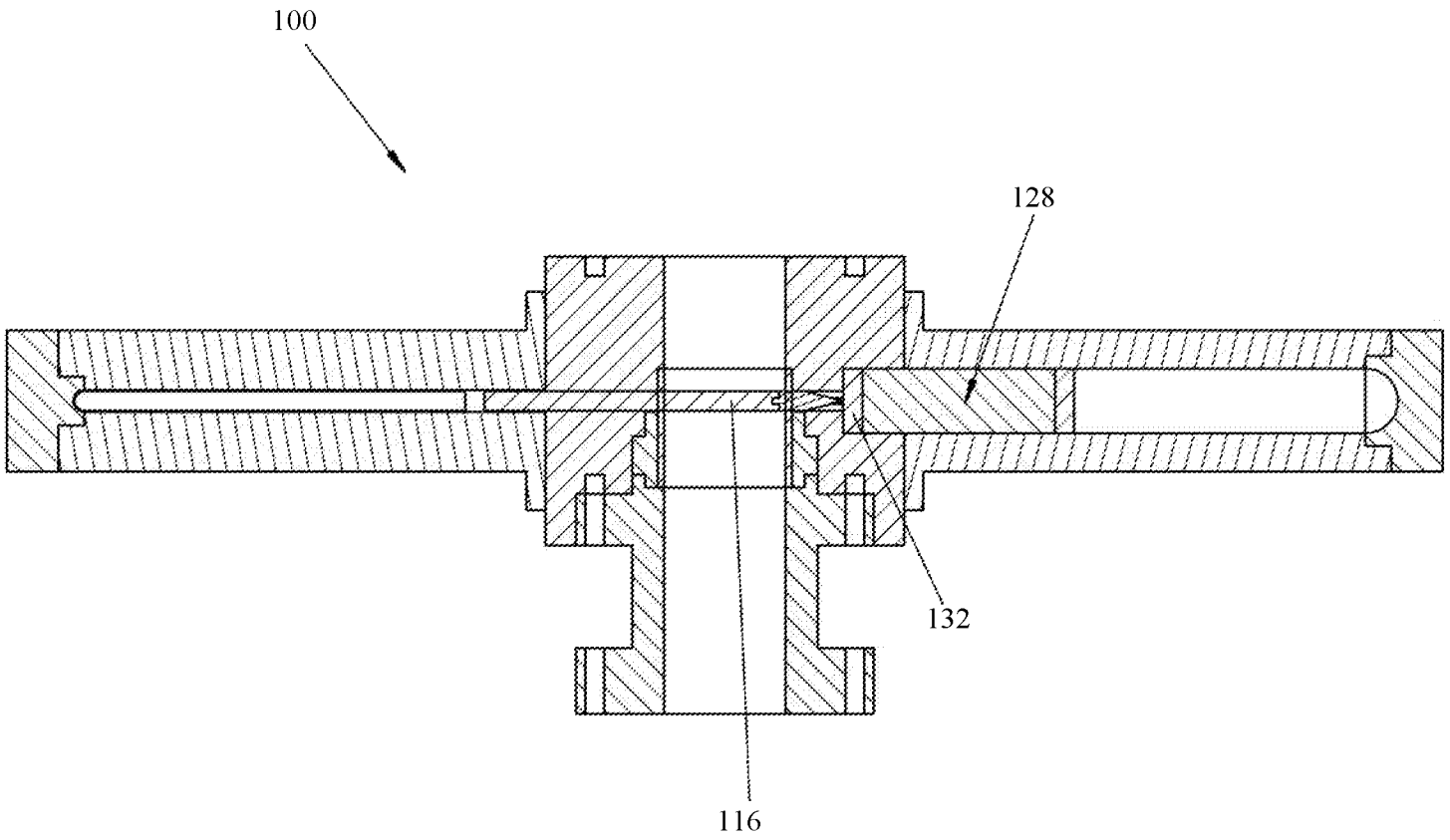
FIG. 7 shows a cross section view of a blowout preventer with the shearing device contacting the energy absorption mechanism.

FIG. 7 shows a cross section view of the blowout preventer 100 where the shearing device 116 has connected with the front portion 132 of the energy absorption mechanism 128. An attachment mechanism (not shown) attaches the shearing device 116 to the front portion 132 of the energy absorption mechanism 128.

Figure 8:
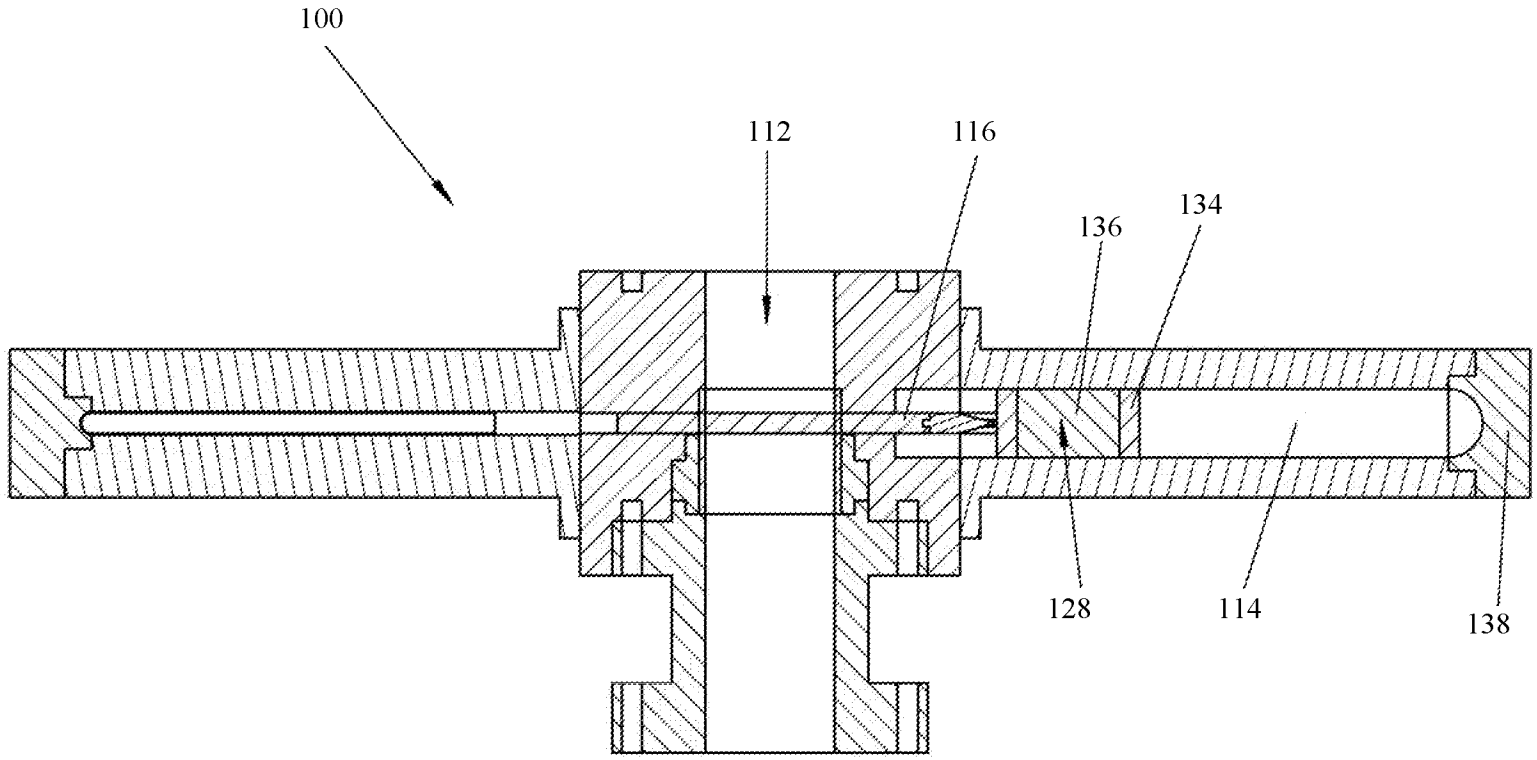
FIG. 8 shows a cross section view of a blowout preventer with the energy absorption mechanism absorbing the kinetic energy of the shearing device.

FIG. 8 shows a cross section view of the blowout preventer 100 where the body of energy absorbing material 136 of the energy absorption mechanism 128 has crumpled to a predetermined amount, absorbing the kinetic energy of the shearing device 116. The hydraulic fluid in the passage 114 between the rear portion 134 of the energy absorption mechanism 128 and the end cap 138 dissipates any residual energy of the shearing device 116.

The energy absorption mechanism 128 will retain the shearing device 116 in such a position that a sealing face (not shown) of the shearing device 116 is sufficiently aligned with the wellbore sealing arrangement 142. Once the shearing device 116 is sufficiently aligned with the wellbore sealing arrangement 142, the sealing arrangement 142 will firmly press a sealing ring (not shown) against the sealing face (not shown) of the shearing device 116, to stop the flow of wellbore fluids through the wellbore 112, securing the well. Once the well is secured, well control operations (for example choke and kill operations) can commence.

Figure 9:
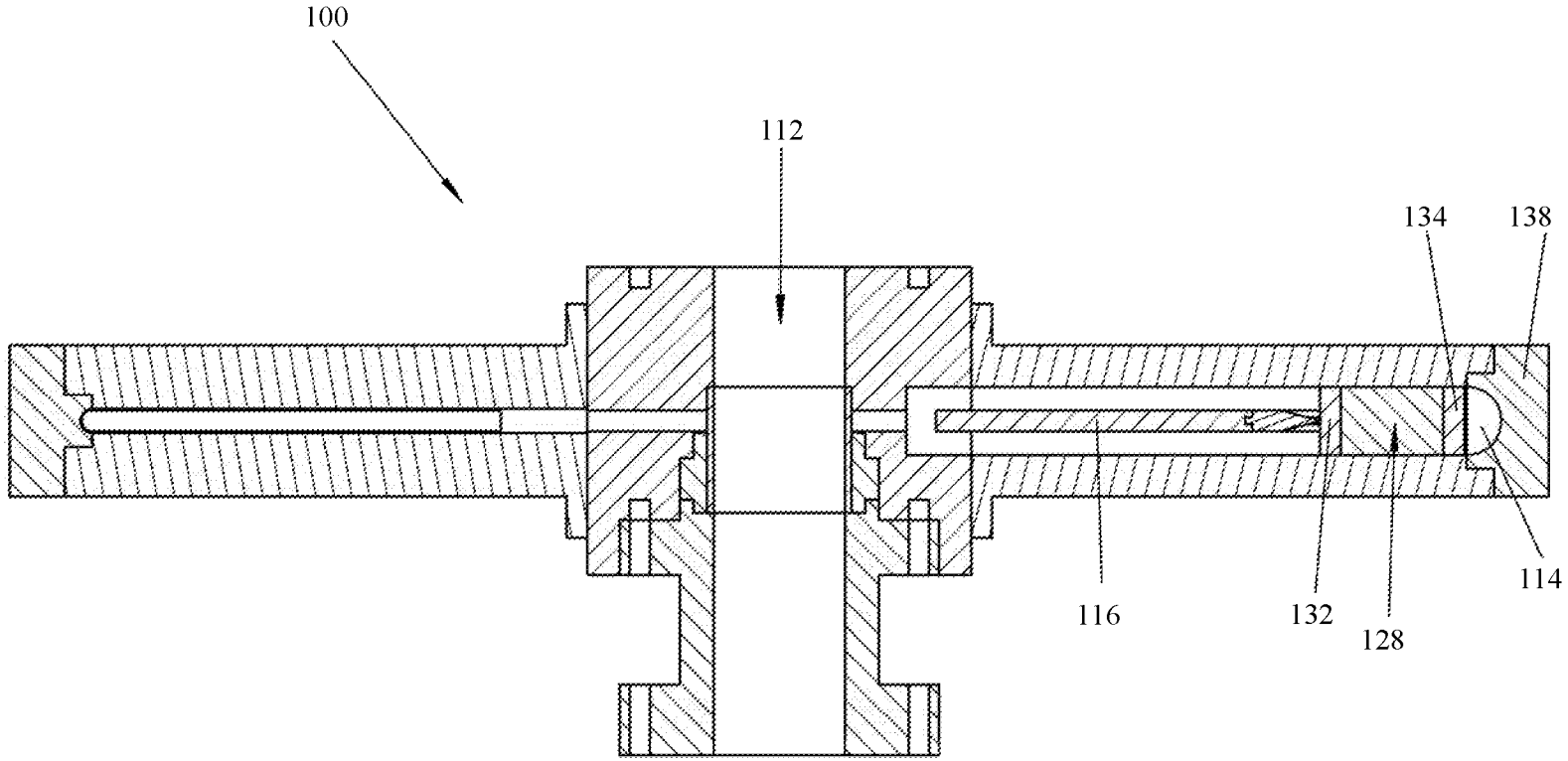
FIG. 9 shows a cross section view of a blowout preventer with the energy absorption mechanism pulling the shearing device clear of the wellbore.

Once well control has been re-established, the blowout preventer 100 can be de-activated as seen in FIG. 9. In FIG. 9, the sealing arrangement 142 retracts the sealing ring (not shown) from the sealing face (not shown) of the shearing device 116, then the hydraulic fluid in the passage 114 between the rear portion 134 of the energy absorption mechanism 128 and the end cap 138 is vented, pulling the energy absorption mechanism 128 along the passage 114 and the shearing device 116, which is attached to the front portion 132 of the energy absorption mechanism 128, clear of the wellbore 112.

Figure 10:
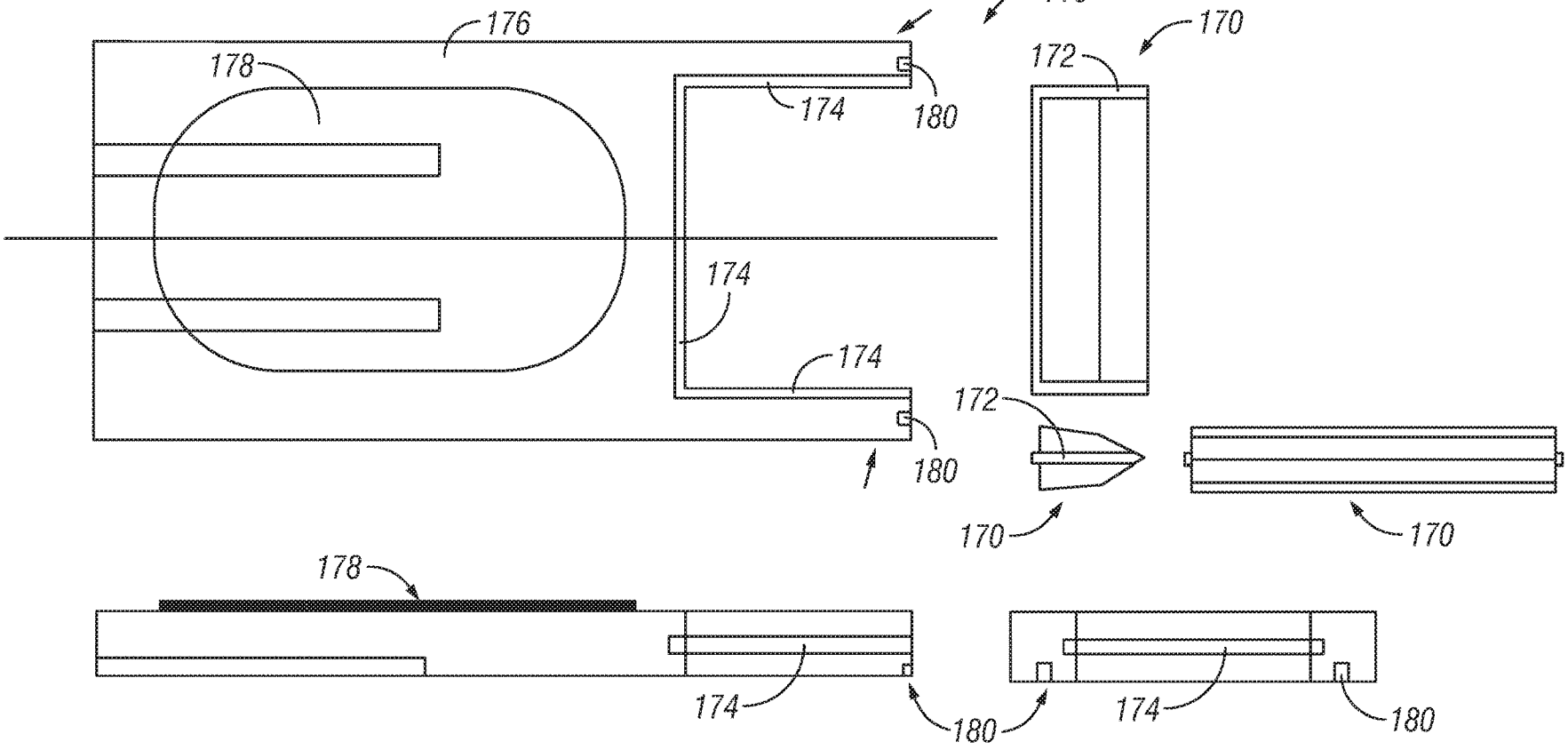
FIG. 10 shows exploded views of a shearing device.

FIG. 10 shows exploded views of a shearing device 116. The shearing device 116 has a cutting edge 170. The cutting edge 170 is made of a very hard material such as metallic or ceramic alloys that can cut through tubular sections which may be present in a wellbore. The cutting edge 170 has a rib 172 extending around its sides and rear face. In the assembled form, the rib 172 sits in a slot 174 of the shearing device 116. The shearing device 116 has a body section 174 that in operation blocks a wellbore and prevents the mass passage of wellbore fluids through the wellbore. The shearing device 116 optionally has a sealing face 178 which is adapted to engage with a wellbore sealing arrangement to prevent passage of wellbore fluids. In an alternate embodiment (not shown), a sealing face may optionally be present on a upper portion of the shearing device.

The shearing device 116 has two slots 180 which are adapted to attach to an energy absorption mechanism.

A possible advantage of a blowout preventer according to the present disclosure is that the blow out preventer can be actuated without having to produce hydraulic forces to hydraulically push rams across the wellbore to close off the wellbore. Instead, the energy required to close the wellbore is contained in the charge in the blowout preventer where it is required.

A possible advantage of holding the shearing device 116 in place by a shear pin is that this assists in the rapid acceleration of the shearing device 116 along the passage 114 once sufficient force has been generated by the expanding gases of the chemical propellant 122.

A possible advantage of having the cylinder 126 fluidly sealing the passage 114 from the wellbore 112 is that the shearing device 116 can accelerate along the passage 114 unhindered by wellbore fluids or other liquids until the shearing device 116 starts to shear the cylinder 126.

A possible advantage of using an energy absorption mechanism 128 is that excess kinetic energy of the shearing device 116 is not directly transferred into a structural portion of the blowout preventer 100.

A possible advantage of pulling the shearing device 116, which is attached to the front portion 132 of the energy absorption mechanism 128, clear of the wellbore 112 is that the shearing device 116 does not have to be drilled through for wellbore operations to recommence.

The foregoing embodiments are illustrative only of the principles of a blowout preventer according to the present disclosure, and various modifications and changes will readily occur to those skilled in the art. The present disclosure is capable of being practiced and carried out in various ways and in other embodiments. For example, individual features from one embodiment may be combined with another embodiment. It is also to be understood that the terminology employed herein is for the purpose of description and should not be regarded as limiting.

In the present specification and claims, the word "comprising" and its derivatives including "comprises" and "comprise" include each of the stated integers but does not exclude the inclusion of one or more further integers unless the context of use indicates otherwise.

What is claimed is:

1. A blowout preventer comprising:

a main body containing a wellbore;

a passage transverse to the wellbore;

a shearing device located in the passage;

a charge that, when activated, propels the shearing device along the passage and across the wellbore; and a concentric seal that extends in the direction of the wellbore to fluidly seal the passage from the wellbore, wherein the passage comprises a space between an initial location of the shearing device and the wellbore, and wherein the space between the initial location of the shearing device and the wellbore is at least as long as half a diameter of the wellbore.

2. The blowout preventer of claim 1, wherein the shearing device has a body section that substantially blocks the wellbore and substantially prevents passage of fluids through the wellbore, the shearing device comprising a cutting edge to cut through tubular sections in the wellbore.

3. The blowout preventer of claim 1, further comprising a retaining device that retains the shearing device in a predefined position in the passage until a sufficient force is exerted on the shearing device.

4. The blowout preventer of claim 3, wherein the retaining device comprises a shear pin.

5. The blowout preventer of claim 1, wherein the charge comprises a chemical propellant.

6. The blowout preventer of claim 5, wherein the charge is activated by an initiator.

7. The blowout preventer of claim 1, wherein the passage comprises a first portion on a first side of the wellbore and a second portion on a second side of the wellbore, and wherein the shearing device is initially located in the first portion of the passage on the first side of the wellbore.

8. The blowout preventer of claim 1, wherein a space between the initial location of the shearing device and the wellbore is longer than a diameter of the wellbore.

9. The blowout preventer of claim 8, wherein the space between the initial location of the shearing device and the wellbore is devoid of liquid.

10. The blowout preventer of claim 1, wherein the passage comprises a liner which fits within the passage.

11. The blowout preventer of claim 1, further comprising an arresting mechanism comprising an energy absorption mechanism adapted to absorb the energy of the shearing device once the shearing device has been propelled across the wellbore.

12. The blowout preventer of claim 11, wherein the arresting mechanism is disposed in the passage.

13. The blowout preventer of claim 11, wherein the arresting mechanism is disposed on an opposite side of the wellbore to the initial location of the shearing device.

14. The blowout preventer of claim 11, wherein the energy absorption mechanism has a front portion facing toward the shearing device, a rear portion, and a body of energy absorbing material located between the front portion and the rear portion, wherein the front portion of the energy absorption mechanism is configured to be attached to the shearing device.

15. The blowout preventer of claim 14, wherein a space behind the rear portion of the energy absorption mechanism is filled with hydraulic fluid.

16. The blowout preventer of claim 14, wherein the rear portion of the energy absorption mechanism contains a sliding piston which is movable within the passage.

17. The blowout preventer of claim 14, wherein a portion of the passage in which the energy absorption mechanism is disposed has a larger cross sectional area than a portion of the passage in which the shearing device is disposed prior to activation of the charge.

18. A method of closing a wellbore located within a main body of a blowout preventer, the method comprising:

activating a charge to propel a shearing device along a passage transverse to the wellbore, such that the shearing device travels across the wellbore to inhibit the flow of wellbore fluids through the wellbore and shear any tubulars or downhole tools that may be present in the wellbore, wherein the shearing device is accelerated along the passage in a space between an initial location of the shearing device and the wellbore, and wherein the space is at least as long as half a diameter of the wellbore; and propelling the shearing device through a seal fluidly sealing the passage from the wellbore.

19. The method of claim 18, wherein the shearing device travels into an energy absorption mechanism located in the passage thereby absorbing kinetic energy of the shearing device.

20. The method of claim 19, wherein the absorbing the kinetic energy of the shearing device comprises hydraulically dissipating the kinetic energy.

21. The method of claim 18, wherein when the charge is activated, expansion of gases accelerates the shearing device along the passage, thereby imparting kinetic energy to the shearing device.

22. The method of claim 21, wherein an amount of kinetic energy imparted to the shearing device is sufficient to shear any device disposed in the wellbore without using energy from the expanded gases.

23. The method of claim 18, further comprising retaining the shearing device at the initial position until a sufficient expansion of the charge has occurred.

24. The method of claim 18, further comprising venting the activated charge into the wellbore.

* * * * *